US005645182A

United States Patent [19]

Miller, Jr. et al.

[11] Patent Number: 5,645,182

[45] Date of Patent: *Jul. 8, 1997

[54] ADJUSTABLE SHELF SUPPORT STRUCTURE

[75] Inventors: Donald J. Miller, Jr., Belleville, Ill.; Keith Harbour, Florissant, Mo.

[73] Assignee: Paul Flum Ideas, Inc., St. Louis, Mo.

[ * ] Notice: The term of this patent shall not extend beyond the expiration date of Pat. No. 5,450,971.

[21] Appl. No.: 506,908

[22] Filed: Jul. 26, 1995

Related U.S. Application Data

[63] Continuation-in-part of Ser. No. 320,735, Oct. 11, 1994, Pat. No. 5,450,971.

[51] Int. Cl.[6] ..... A47F 5/00

[52] U.S. Cl. ..... 211/134; 108/107; 211/153; 211/175; 211/187

[58] Field of Search ..... 211/134, 59.2, 211/175, 181, 187, 153, 184; 108/162, 107, 137, 144

[56] References Cited

U.S. PATENT DOCUMENTS

| | | | |
|---|---|---|---|
| 3,998,170 | 12/1976 | Gordon | 211/181 X |
| 4,267,931 | 5/1981 | Belotta | 211/181 X |
| 4,331,243 | 5/1982 | Doll | 211/59.2 |
| 4,416,380 | 11/1983 | Flum | 211/59.2 |
| 4,444,320 | 4/1984 | Chap | 211/134 |
| 4,478,337 | 10/1984 | Flum | 211/59.2 |
| 4,553,523 | 11/1985 | Stohrer | 211/175 X |
| 4,593,823 | 6/1986 | Fershko et al. | 211/49.1 |
| 4,690,287 | 9/1987 | Fershko et al. | 211/49.1 |
| 4,801,025 | 1/1989 | Flum et al. | 211/128 |
| 5,197,609 | 3/1993 | Siegel | 211/175 X |
| 5,450,971 | 9/1995 | Boron et al. | 211/134 |

*Primary Examiner*—Robert W. Gibson, Jr.
*Attorney, Agent, or Firm*—Haverstock, Garrett & Roberts

[57] ABSTRACT

An adjustable shelf support structure adaptable for use in combination with existing refrigerated display coolers and other types of product merchandising display equipment including first and second members which are engageable with each other such that the first and second members can be moved relative to each other to change the overall width of the support structure, the first and second members further including a mechanism for varying the effective length of the support structure so as to change the overall depth thereof, the first and second members when engaged with each other being capable of both width and depth adjustment to accommodate the varying width and depth dimensions associated with existing product merchandising display equipment. The present shelf support structure can be seated on existing support clips which are attached to upright support members commonly associated with existing display equipment, the support clips being selectively engageable with such upright support members at various intermediate locations thereal-ong so as to orient the present support structure in either a substantially flat horizontal position or in an inclined position for gravity feed operations.

23 Claims, 5 Drawing Sheets

ADJUSTABLE SHELF SUPPORT STRUCTURE

This application is a continuation in part of application Ser. No. 08/320,735, Oct. 11, 1994, now U.S. Pat. No. 5,450,971, the specification of which is incorporated herein by reference.

The present invention relates to a shelf support structure for supposing product merchandising units and the like and, more particularly, to several new embodiments of an adjustable shelf support structure primarily designed for use in certain types of existing refrigerated display coolers and other types of cold vaults, the present support structures being mountable on clips, tabs or other similar support means within such existing coolers in spaced apart relationship either one above the other, or between existing shelving associated with such coolers, to form a two-tier arrangement or a multi-tier arrangement upon which product merchandising units can be placed to merchandise shelved products therefrom. The present support structures increase and maximize available shelf capacity, particularly the vertical space between existing shelves; they include both width and depth adjustment means; and they can be mounted in either a flat horizontal position or in an inclined position for gravity feeding products positioned thereon. Although the present units are ideally suited and primarily designed for use in refrigerated display cases commonly utilized in supermarkets, convenience stores, and other food and beverage outlets, they are likewise adaptable for use in many other display shelf applications.

BACKGROUND OF THE INVENTION

A wide variety of display devices have been designed and manufactured for use in merchandising shelved products to consumers. One of the major problems associated with storing and displaying shelved products for sale to consumers and, in particular, shelved products requiring refrigeration in display coolers and other types of cold vaults, is the inefficient use of available shelf space, particularly, the vertical space available between adjacent shelves. Although various product display devices have been designed to alleviate this particular problem such as the two-tier systems disclosed in U.S. Pat. Nos. 4,593,823 and 4,801,025, such units are not always adaptable for use within refrigerated display coolers since the spatial dimensions associated with existing coolers vary from one refrigerated unit to the next. Also, such prior art two-tier shelving units are tied to each other and such systems are not always easily maneuverable within a particular cold vault, particularly, when such units are loaded with product. The relative stability of existing two-tier systems is also of some concern particularly in light of the advent of the larger product containers commonly used, for example, in the soft drink industry. It is therefore a principal aim of the present invention to obviate many of the disadvantages and shortcomings associated with the known prior art devices and to provide shelf support structures which are compatible for use with many of the existing refrigerated display coolers, which are both width and depth adjustable, and which enable a user to form a multi-tier shelf system within a refrigerated cooler thereby maximizing usage of the vertical space available between adjacent product merchandising units. As described in co-pending application Ser. No. 08/320,735, several embodiments of a shelf support structure include a plurality of hook members for supporting the shelf support structure in coolers configured to accommodate such hook members. Described in the present application are several embodiments of the present shelf support structure configured to be supported by clips, tabs or other similar support means in coolers which include such clips, tabs or other means.

SUMMARY OF THE INVENTION

The present shelf support structures have overcome many of the disadvantages and short comings associated with the known two-tier product display shelf devices and teach the construction and operation of several embodiments of an adjustable support assembly which is adaptable for use with existing refrigerated shelf cooler equipment, either in a flat horizontal position or in an inclined position for gravity feed operations. The present support structures can be used for supporting product merchandising units designed to display both chilled and unchilled products and are particularly well suited for holding and supporting a wide variety of known product merchandising units specifically designed to merchandise and display a wide variety of soft drink type products including fruit juices, dairy products and the like, which product display devices are commonly used in supermarkets, convenient stores, and a multitude of other food and beverage outlets. The present shelf support structures are of an open grid rod-type construction and includes first and second relatively movable members which, in combination, define a substantially horizontal grid structure capable of supporting a wide variety of product merchandising units thereupon. The first and second members are engageable with each other in such a manner that the overall width of the structure is easily adjustable so as to accommodate varying shelf widths associated with the wide variety of known refrigerated coolers and other shelving equipment. The rod members forming the opposed side portions of the support structure each likewise include adjustment means for enabling the overall length of the support structure to be adjusted to accommodate varying shelf or cooler depths. The very fact that the present support structures are both width and depth adjustable greatly facilitates their use in a multitude of different merchandising applications.

The present shelf support structures are specifically designed for use with known cooler assemblies, such as visi-coolers manufactured by True, Beverage-Air, Hussman, Star, Cornelius and Vendo to name a few. These visi-cooler assemblies include upright support members attached to the inside walls of the coolers, which upright support members further include slots, notches, or other openings configured to adjustably receive support clips or tabs upon which various shelves are placed. The present shelf support structures are specifically designed to rest upon the support clips associated with the respective upright support members of the particular cooler assembly in question, which support clips may include an upwardly extending portion against which a portion of the present shelf support structures are fitted. More particularly, a portion of each opposed side rod member located in the vicinity of each of the four respective corners of the present support structures is seated upon a support clip or tab such that the upwardly extending portion of the support clip is positioned to the interior of the shelf support structure thereby preventing the shelf support structure from sliding off of the respective support clips. In addition, each opposed side rod member includes a downwardly extending portion positioned towards the front of the structure which engages or cooperates with the forwardmost support clips so as to prevent the present shelf support structure from sliding forward. Also, importantly, since each cooler upright support member includes a plurality of slots, notches, or other openings configured to receive the support clips, the support clips can be adjustably positioned on the upright support members relative to each other such that when any one of the present shelf support structures is placed thereupon, the support structure will achieve either a flat horizontal position or an inclined position for gravity feed type operations. The inclined orientation is achieved by simply elevating the rear support clips relative to the front support clips so as to produce a suitable inclination such that when a product merchandising unit is positioned upon any one of the present shelf support structures, products positioned within such merchandising unit will slide forward under the force of gravity towards the front portion of such unit.

Because of the adjustability of the present support structures, they can be used to hold and support product merchandising units specifically designed to merchandise specific types of products such as, in the soft drink industry, soft drink products packaged in cans, or in 12 ounce, 16 ounce, 20 ounce, 1 liter, 2 liter, or 3 liter plastic containers. This capability maximizes the use of the present shelf support structures in most existing refrigerated cooler applications and obviates the need for utilizing a plurality of different merchandising units to both accommodate different styles of product containers and to achieve different product display configurations. Because of their versatility and ability to achieve any selected depth and width, the present shelf support structures represent a one-inventory solution to a user enabling such user to organize and configure any particular refrigerated cooler to meet his/her specific needs and space requirements. Also, importantly, use of the present adjustable shelf support structures is extremely cost effective because such support structures are adaptable for use with existing shelving equipment; such support structures require no additional parts, tools, or other means for interconnecting the same into a particular refrigerated cooler; and such support structures can be utilized either in a flat horizontal orientation or in an inclined orientation for gravity feed operations.

It is therefore a principal object of the present invention to provide a shelf support structure adaptable for use with existing shelving systems commonly utilized in supermarkets and other merchandising centers including shelf systems associated with refrigerated display coolers, particularly, visi-coolers.

Another object is to provide an adjustable shelf support structure which more effectively utilizes available merchandising areas associated with refrigerated display coolers, particularly, visi-coolers.

Another object is to provide a shelf support structure wherein both the depth and width of the support assembly is adjustable to increase the overall size thereof.

Another object is to provide a more efficient and simpler means for double-stacking a pair of product merchandising units to provide increased packout within a given amount of merchandising space.

Another object is to teach the construction and operation of a shelf support structure which can be utilized to achieve a multi-tier display arrangement within existing refrigerated visi-coolers and other known shelving systems.

Another object is to provide a shelf support structure which reduces and saves the vertical space between shelved products in certain display applications such as existing refrigerated visi-coolers and other known shelving systems.

These and other objects and advantages of the present invention will become apparent to those skilled in the art after considering the following detailed specification in conjunction with the accompanying drawings wherein:

Figure 1:
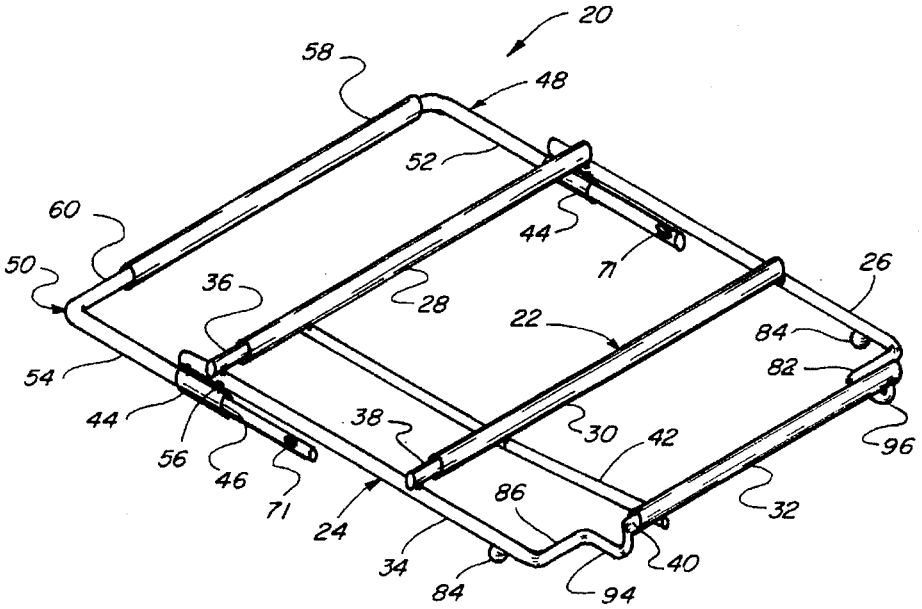
FIG. 1 is a perspective view of one embodiment of the present adjustable shelf support structure constructed according to the teachings of the present invention, the present support structure being shown in its fully collapsed or unexpanded position.
Figure 4:
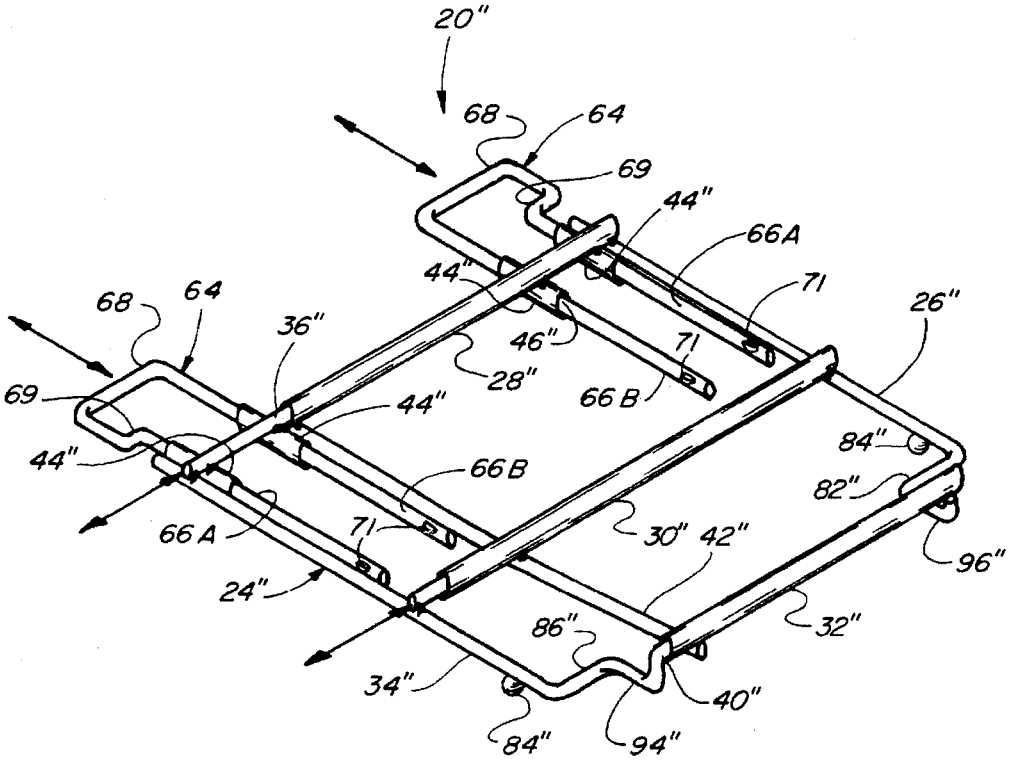
FIG.4 is a perspective view of still another embodiment of the present adjustable shelf support structure illustrating an alternative configuration for varying the overall depth of the present support structure.
Figure 7:
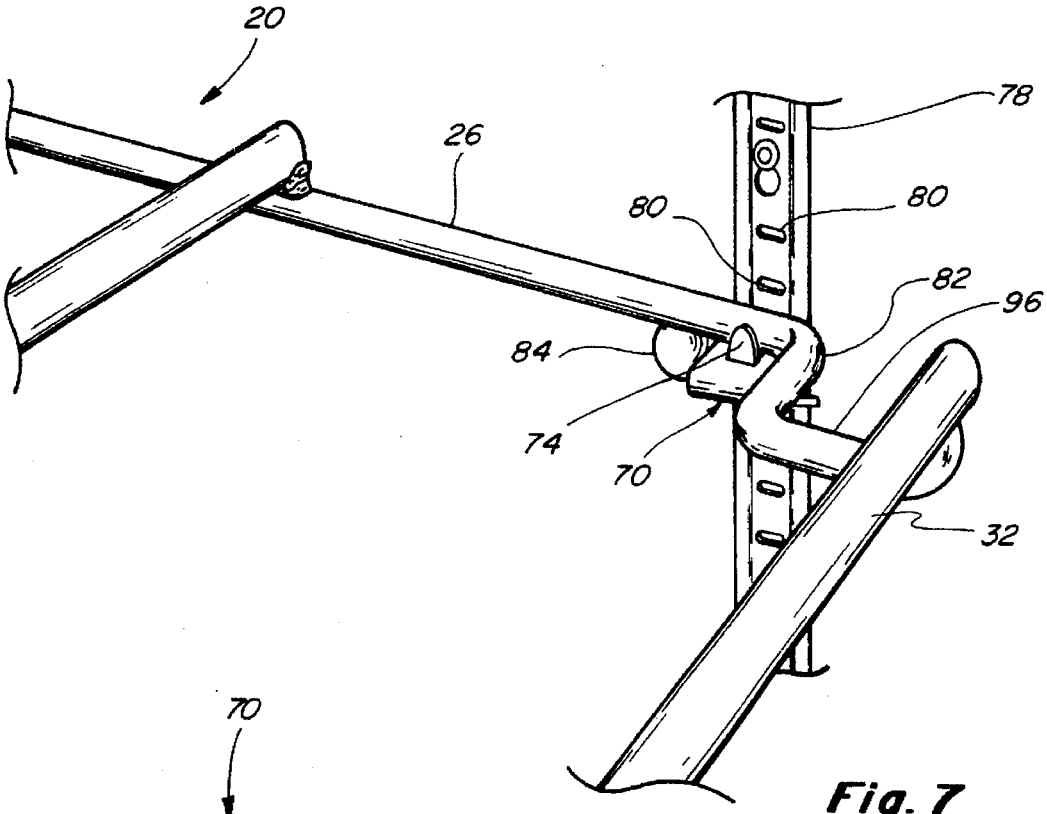
Figure 5:
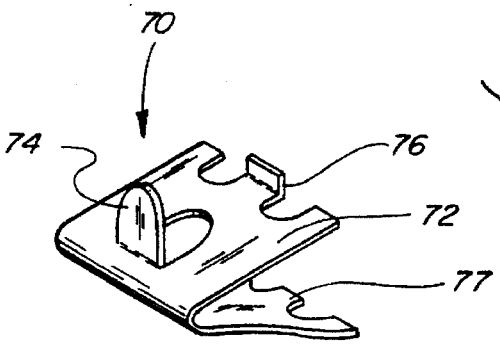
FIG. 5 is a perspective view of a typical support clip used in conjunction with any one of the present shelf support structures and many of the existing refrigerated cooler assemblies.
Figure 6:
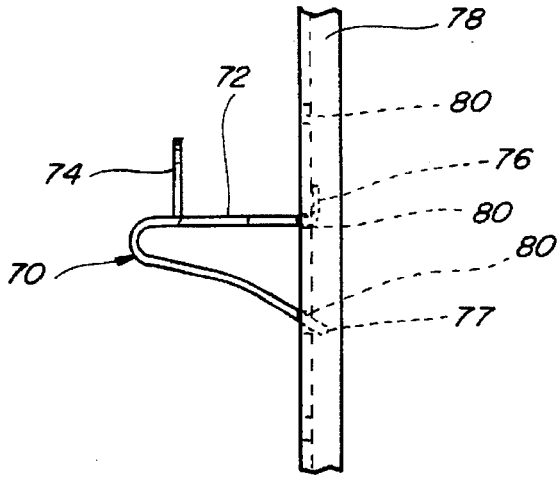
Figure 8:
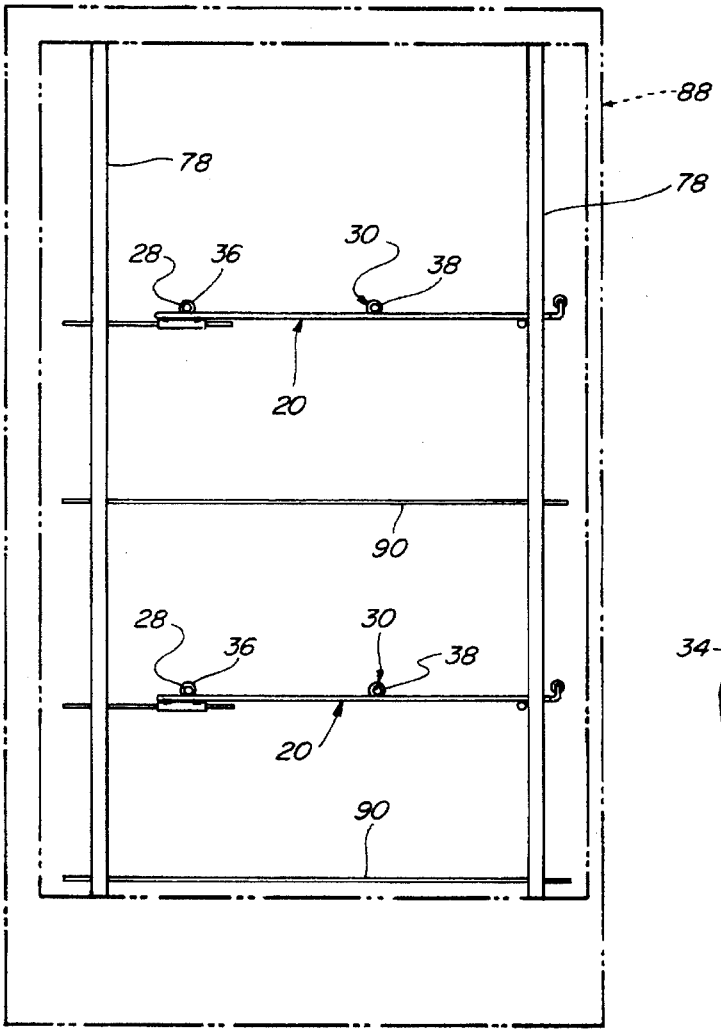
Figure 11:
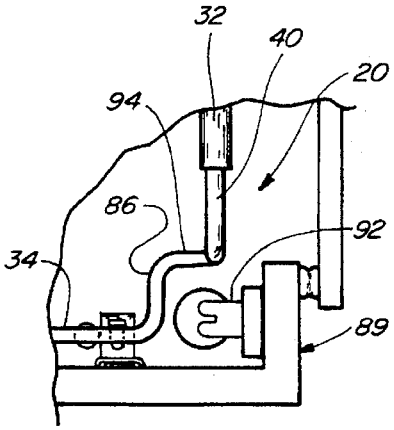
Figure 9:
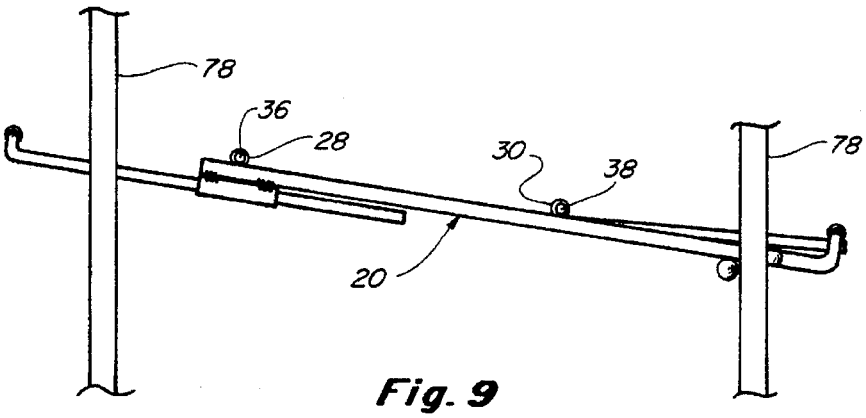
Figure 10:
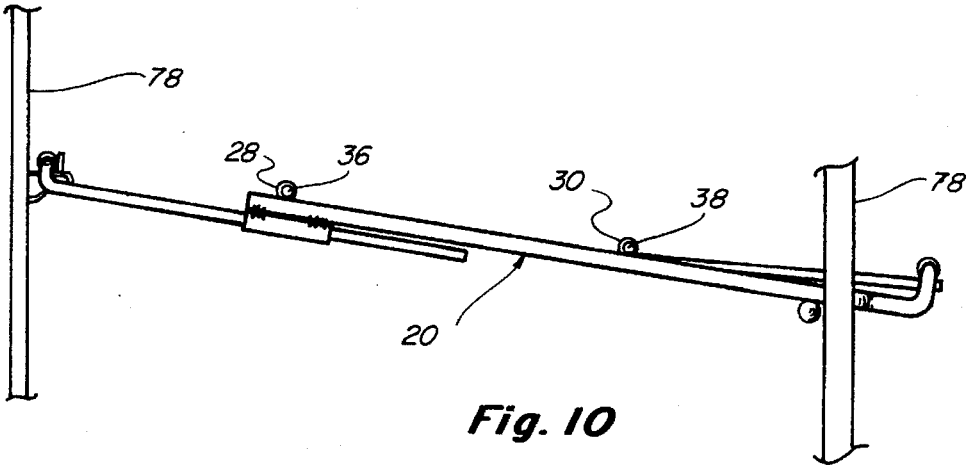
Figure 12:
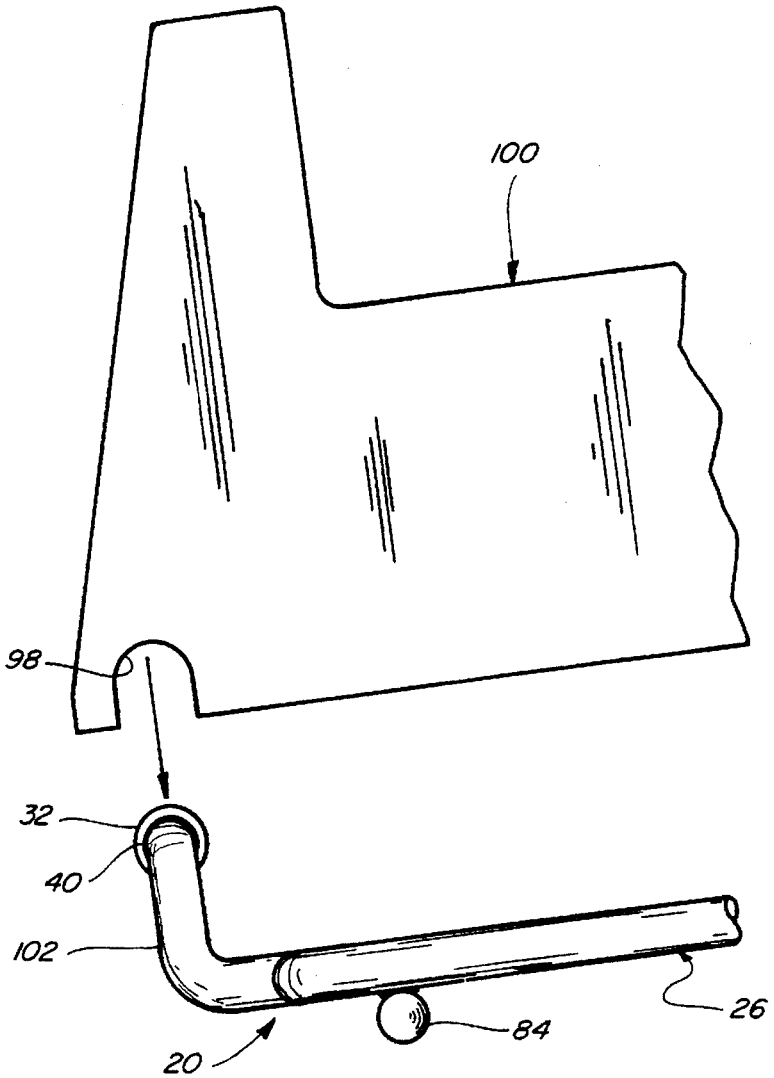

FIG. As a side elevational view of the support clip of FIG. 4 mounted unto an upright support member associated with a typical refrigerated cooler assembly;

FIG. 7 is a partial perspective view of the left front corner of the shelf support structure of FIG. 1 showing ,the shelf support structure seated on the support clip of FIGS. 5 and 6;

FIG. 8 is a side elevational view illustrating one embodiment of the present shelf support structure mounted in a typical refrigerated cooler assembly in a substantially flat horizontal orientation;

FIGS. 9 and 10 are partial side elevational views showing one embodiment of the present support structure mounted in an inclined orientation for gravity feed operation in two differently configured cooler assemblies;

FIG. 11 is a partial top planform view of the front right corner of the present shelf support structure of FIG. 1 mounted in a typical refrigerated cooler assembly having vertical light means associated with the front corner portions thereof; and FIG. 12 is a partial side elevational view illustrating the relationship between certain product merchandising units and the front portion of any one of the present shelf support structures.

DETAILED DESCRIPTION OF THE INVENTION

Figure 2:
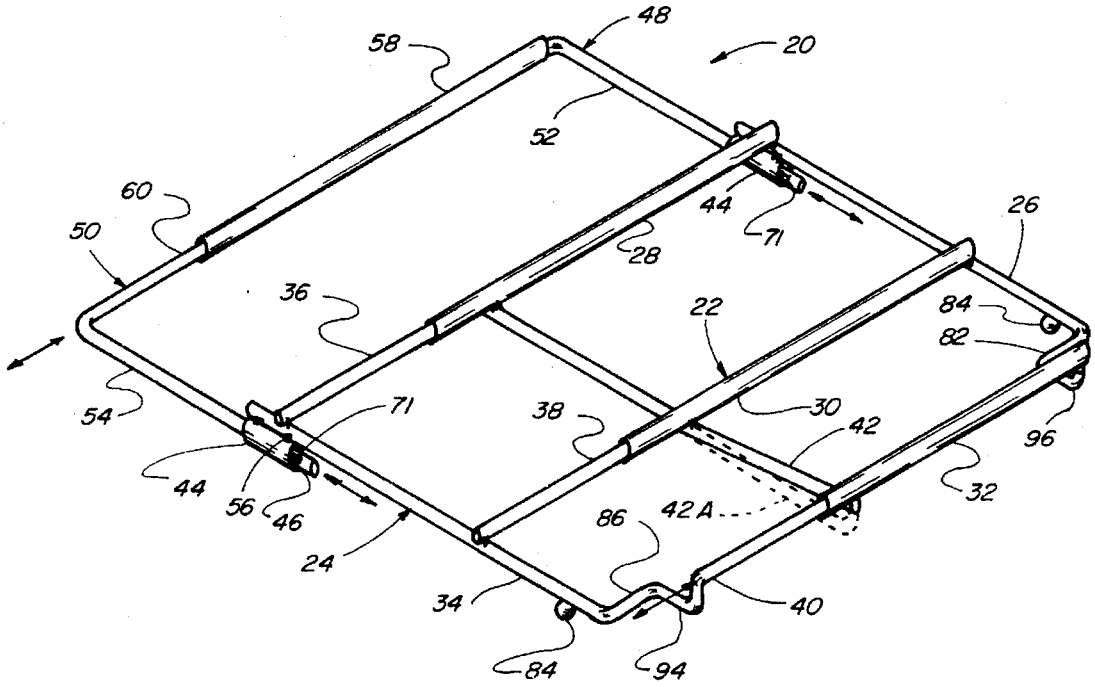
FIG. 2 is a perspective view of the embodiment of FIG. 1 showing the present shelf support structure in an expanded position.

Referring to the drawings more particularly by reference numbers wherein like numerals refer to like parts, number 20 in FIG. 1 identifies one embodiment of an adjustable shelf support structure constructed according to the teachings of the present invention. The shelf structure 20 includes members 22 and 24 which, in combination, define a substantially horizontal open grid wire or rod type structure capable of supporting a wide variety of product merchandising units when placed thereupon. The members 22 and 24 are telescopingly engageable with each other as best shown in FIGS. 1 and 2 such that the overall width of the structure 20 can be easily adjusted to accommodate any shelf width. The member 22 includes a rod member 26 which comprises one side portion of the overall structure 20 as well as a plurality of tubular type members 28, 30 and 32, the members 28-32 being oriented substantially perpendicular to rod member 26 as best shown in FIGS. 1 and 2. The members 28–32 form a major portion of the support surface upon which other product merchandising units will be placed for merchandising products therefrom.

The member 24 is constructed substantially similar to member 22 and includes a rod member 34 which forms the opposed side portion of the overall structure 20 as best shown in FIGS. 1 and 2. Like the member 22, the member 24 includes a plurality of rod members 36,38 and 40 which are oriented substantially perpendicular to rod member 34 and, importantly, are positioned and located so as to be slidably insertable within the corresponding tubular members 28–32 as shown in FIGS. 1 and 2. When positioned in telescoping relationship with each other, the tubular members 28–32 lie in alignment with the rod members 36–40 to form continuations thereof, the members 22 and 24 being slidably movable relative to each other to adjust the overall width of the structure 20. This telescoping feature allows a user to conveniently adjust the overall width of the structure 20 between the respective side portions 26 and 34 to accommodate varying shelf widths commonly associated with a wide variety of known shelving equipment including refrigerated coolers. In this regard, FIG. 1 illustrates the present shelf structure 20 in its fully collapsed or unexpanded position whereas FIG. 2 illustrates the present shelf structure 20 in an expanded width position.

The member 22 may also include an additional rod support member 42 positioned intermediate the respective side members 26 and 34 as best shown in FIG. 1 so as to provide additional support and stability to the overall structure 20, particularly, when the member 24 is moved to an expanded width position. The rod member 42 is preferably located towards the free end portion of the tubular members 28–32 as shown for obvious reasons, although any plurality of additional support rod members 42 may be spacedly arranged between the member 26 and the free end portions of the tubular members 28–32 depending upon the size and weight of the particular product merchandising unit placed thereupon as well as the size and weight of the particular products to be merchandised therefrom. In this regard, it is also recognized that any plurality of tubular members 30 and corresponding rod members 38 may likewise be positioned and located in spaced relationship between the front and rear portions of the overall shelf support structure 20 so as to provide an adequate support surface for the product merchandising unit placed thereupon again depending upon the type and weight of the products to be merchandised therefrom. Regardless of the total number of cooperatively engageable cross members associated with the members 22 and 24 such as the members 28–32 and 36–40, the tubular members such as the members 28–32 must be adaptable to slidably receive and telescopingly cooperate with their corresponding rod members such as the members 36–40 as explained above. However, as will be hereinafter further explained, it is also contemplated that the cross members such as members 28–32 and 36–40 can be configured for non-telescopic cooperation as best shown in FIG. 3.

Each of the rod members 26 and 34 forming the opposed side portions of the shelf structure 20 likewise include adjustment means for enabling the overall length of each such rod member to be adjusted to accommodate varying shelf or cooler depths. As best shown in FIGS. 1 and 2, the rod members 26 and 34 each include a bracket member 44, each bracket member 44 including an opening or channel 46 adaptable for receiving a rod member associated with the rear members 48 and 50. More particularly, the rear members 48 and 50 are telescopingly engageable with each other and each member 48, 50 includes an extension rod portion 52, 54 respectively which is shaped and dimensioned so as to be cooperatively receivable within the bracket openings or channels 46 as best shown in FIGS. 1 and 2. The bracket members 44 are fixedly attached to the side rod members 26 and 34 via any suitable means such as by spot welding the same to their respective rod members as shown at 56. The extension rod members 52, 54 are slidably movable within each bracket opening 46 so as to increase the overall depth or length of the structure 20 from front to rear to accommodate varying shelf or cooler depths. The overall length of the extension rod members 52, 54 will depend upon the amount of additional shelf depth extension required for any particular application. Rear member 48 also includes a tubular portion 58 oriented substantially perpendicular to extension rod portion 52 while rear member 50 includes a rod portion 60 oriented substantially perpendicular to extension rod portion 54, the rear portions 58 and 60 being positioned and located so as to telescopingly engage each other as shown in FIGS. 1 and 2. This telescoping arrangement facilitates adjustment of the overall width of the support structure 20 as described above in reference to members 28–32 and 36–40. It is also recognized and anticipated that other bracket and rear member arrangements as well as other bracket and rear member configurations may likewise be utilized to accomplish the shelf depth adjustment capability of the present assemblies.

Figure 3:
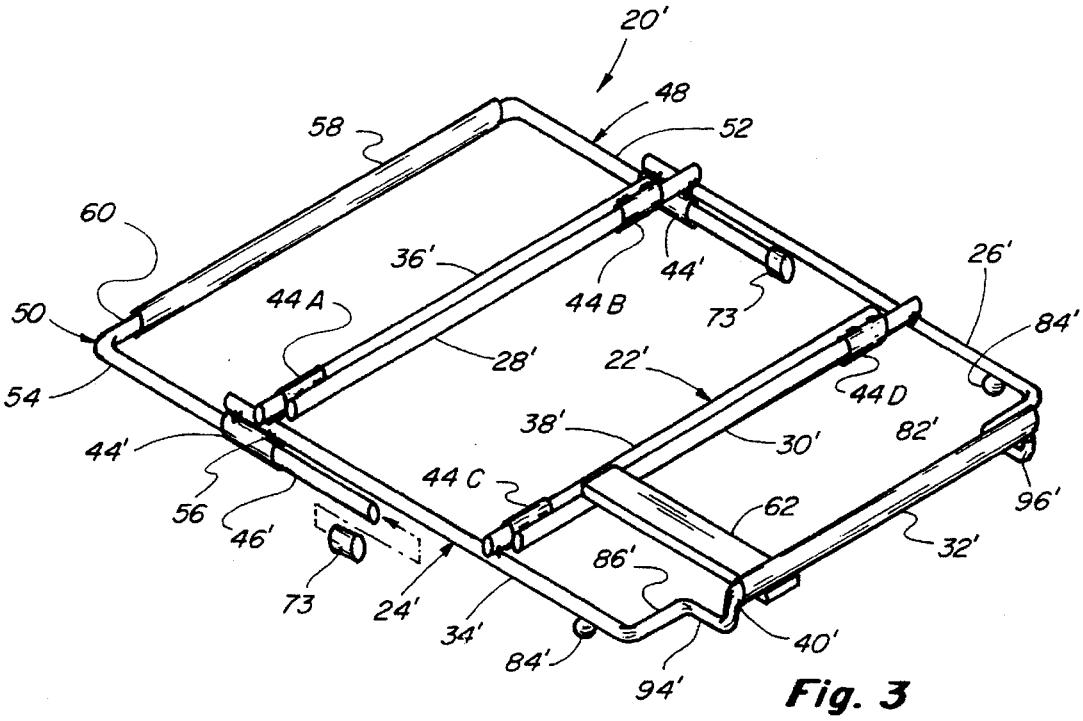
FIG. 3 is a perspective view of another embodiment of the present adjustable shelf support structure illustrating an alternative configuration for varying the overall width of the present support structure.

An alternative configuration for adjusting the width of the present support structure is illustrated in FIG. 3. In this embodiment 20', the members 28', and 30' are not tubular in construction as compared to the members 28 and 30 of FIGS. 1 and 2, and the members 28', 30', 36' and 38 include bracket members 44A, 44B, 44C, and 44D respectively. The shelf support structure 20' is formed by slidingly engaging bracket members 44A, 44B, 44C, and 44D over the members 36', 28', 38' and 30' and thereafter substantially aligning the members 22' and 24' such that the bracket members 44A, 44B, 44C, and 44D can be welded or otherwise affixed to corresponding members 28', 30', 36' and 38' respectively. It is recognized that the size, location, and number of bracket members 44A–D utilized can vary. In the embodiment 20' illustrated in FIG. 3, the width of the shelf structure 20' is variable from the illustrated fully collapsed position to a fully expanded position in which bracket member 44D engages support member 62 which extends from the lower portion of the member 32' to the upper portion of the member 30'. Accordingly, the members 22' and 24' are not separable once the bracket members 44A, 44B, 44C, and 44D have been fixedly attached. However, it is contemplated that by relocating or reducing the number of bracket members 44A–D and removing the support member 62, the member 22' and the member 24' could be formed so as to be separable. Except for the differences noted above, the construction of the members 22' and 24' is substantially similar to the construction of the members 22 and 24 previously explained including the construction and operation of the rear members 48 and 50 used in conjunction therewith.

An alternative configuration for adjusting the length of the shelf structure 20 is illustrated in FIG. 4. In this embodiment 20", each of the members 22" and 24" includes a pair of bracket members 44", one pair being attached to the underside portion of member 28" and one pair being attached to the underside portion of the member 36" as shown in FIG. 4. In this particular embodiment, the tubular member 28" has been shortened to facilitate attachment of the pair of bracket members 44" to the member 36". The bracket members 44" are constructed similar to bracket members 44 and each includes an opening or channel 46" adaptable for receiving a rod member associated with the pair of rear members 64. More particularly, each rear member 64 includes a pair of extension rod members 66A and 66B which are positioned and located in substantially parallel relationship to one another as well as to the members 26", 34" and 42" as shown in FIG. 4. The spacing between the extension rod members 66A, 66B is substantially the same as the spacing between each pair of bracket members 44" so that the extension rod members 66A, 66B are slidably receivable within the bracket member openings 46" thereby allowing the overall length of the shelf structure 20"to be adjusted. Each rear member 64 also includes a transverse rod member 68 oriented substantially perpendicular to and extending between the rod members 66A, 66B. The specific configuration of the rear members 64 provides sufficient support structure for holding and supporting the rear portion of any of the known product merchandising units which can be utilized in conjunction with the structure 20", each rear member 64 being slidingly adjustable so as to accommodate varying shelf or cooler depths and so as to rest upon a support clip 70 (FIG. 5) as will be hereinafter explained. The overall length and width of the support structure 20" can therefore likewise be varied to accommodate the particular cooler dimensions into which the structure 20" is placed.

FIG. 5 illustrates a typical support clip 70 commonly used with known refrigerated visi-cooler assemblies such as the visi-coolers manufactured by True, Beverage-Air, Hussman, Star, Cornelius, Vendo and others. The clip 70 includes a seating or bearing surface 72 and a retaining member 74 which extends upwardly therefrom as shown. A pair of projection members 76 and 77 are associated with one side of the support clip 70 as best illustrated in FIGS. 5 and 6, the projection members 76 and 77 being removably engageable with any pair of a plurality of slots or openings commonly associated with the upright support members utilized in many of the known cooler assemblies and other shelving equipment such as the vertically spaced openings or slots 80 associated with the upright support member 78 illustrated in FIGS. 6 and 7. The upright support member 78 is typical of the type of vertical support means utilized in the known visi-cooler systems and other load carrying rack assemblies.

In application to known coolers, each of the present shelf structures 20, 20' and 20" rests on the surfaces 72 of four support clips 70 positioned on the upright cooler support members in the vicinity of the respective four corners of the present shelf support structures such as the partial arrangement illustrated in FIG. 7. In FIG. 7, the clip 70 is mounted onto the support member 78 by insertion into an adjacent pair of slots 80 and the front left portion of the side member 26 rests on the clip seating surface 72. The retaining member 74 extends upward from the seating surface 72 such that the side member 26 is located intermediate the retaining member 74 and the support member 78. Similarly, other portions of the shelf structure 20 not illustrated in FIG. 7 which rest on clip seating surfaces 72 are also located intermediate the retaining member 74 and the corresponding cooler support member 78. In this configuration, the clip retaining members 74 prevent the side members 26, 34, 52 and 54 from sliding away from the support members 78 and off of the respective clip seating surfaces 72. Excessive forward or rearward sliding of the side members 26 and 34 relative to the support clips 70 is also prevented. In this regard, the respective front portions of the side members 26 and 34 include inwardly extending portions 82 and 86 respectively (FIGS. 1–4 and 7) and a downwardly extending projection portion 84. The inwardly extending portions 82 and 86 are configured to prevent the side members 26 and 34 from sliding rearward along the clip surfaces 72 since the portions 82 and 86 engage the respective clip retaining members 74 as the side members 26 and 34 move rearwardly therealong. This prevents any further rearward movement of the side members 26 and 34. With respect to forward movement of the side members 26 and 34, the downwardly extending projection portions 84 associated respectively therewith are configured to engage the front support clips 70 so that excessive forward movement is likewise prevented. In the particular embodiments disclosed herein, the downwardly extending projection portions 84 are ball shaped in construction and each is attached to the respective side rod member via any suitable means such as by spot welding. It is also contemplated that the downwardly extending portions 84 could be formed integral with the side members 26 and 34 and that such portions 84 could likewise take on a wide variety of other shapes and/or configurations without departing from the spirit and scope of the present invention.

When mounted in various known coolers, each of the four corners of the present shelf structures 20, 20' and 20" are supported by the clips 70. As one can easily ascertain from reviewing FIGS. 1–4 and 7, the front portion of each of the various embodiments of the present shelf support structure is similarly constructed and the front right hand portion of the side members 34, 34' and 34" engages the clip 70 in a similar fashion as shown in FIG. 7. With respect to the rear portion of the shelf support structures 20 and 20' illustrated in FIGS. 1–3, forward movement of the rear members 48, 50 is prevented by engagement of the rear clip retaining members 74 with the tubular member 58 and the rod member 60 respectively. In the embodiment 20" illustrated in FIG. 4, forward movement of the rear members 64 is prevented by similar engagement of the rear clip retaining members 74 with the rod members 68. In this particular embodiment, since the members 64 are designed to engage and rest upon the rear clips 70 intermediate the rod portions 68 and 69, the inwardly extending rear member portions 69 likewise engage the respective clips 70 and prevent rearward movement of the members 64.

Since the rear members 48, 50 and 64 are free to slide within their respective bracket members 44, 44' and 44", each rod portion 52, 54, 66A and 66B may further include stop means at one end portion thereof as illustrated in FIGS. 1'4, such stop means preventing the rear members 48, 50 and 64 from becoming disengaged with the bracket members 44, 44' and 44" once fully extended. These stop means can comprise a bead or projection formed on the associated rod member such as the stop members 71 illustrated in FIGS. 1, 2 and 4, or such stop means can be formed by swaging or otherwise deforming the associated rod member at the appropriate location therealong so as to prevent the same from passing through the respective bracket opening or channel 46, 46' and 46". In addition, as illustrated in FIG. 3, such stop means may take the form of a removable cap member 73 which is slidably engageable with the one end portion of each respective rod portion 52 and 54 as illustrated. When engaged with such rod portions 52 and 54, the cap member 73 functions identically to stop means 71 in that it prevents the rear members 48 and 50 from becoming disengaged with the bracket members 44' when fully extended. More importantly, in total contrast to use of the stop means 71, the stop member 73 is slidably removable from the end portion of each respective rod portion and, when so removed, allows each rear member 48 and 50 to be slidably removed from its respective bracket member 44' thereby enabling the shelf support structure 20' to be disassembled for storage or shipment. Use of the removable stop means 73 also allows a user to change and/or replace the individual rear members 48 and 50 depending upon the particular application involved or normal wear and tear on such members. It is anticipated and contemplated that the removable stop means 73 can likewise be utilized on embodiments 20 and 20" disclosed in FIGS. 1, 2 and 4, and it is further recognized that still other suitable stop means besides stop means 71 and 73 may likewise be utilized in the practice of the present invention.

FIG. 8 illustrates a typical application of the present shelf support structure 20 in a typical refrigerated cooler. More particularly, FIG. 8 discloses a side elevational view of a conventional refrigerated display cooler 88 having upright support members 78 associated therewith as well as some shelf members 90 which are selectively positionable at various intermediate locations along the length of the upright support members 78. In the particular display arrangement illustrated in FIG. 8, the shelf members 90 are oriented in a substantially flat horizontal position and the present shelf support structures 20 are positioned therebetween. Placement of the present shelf support structures 20 in the display cooler 88 is accomplished by slidably moving the members 22, 24, 56 and 58 relative to each other in order to achieve the desired width between the upright cooler support members 78 and the rear extension rod member portions 52, 54 are slidably moved within the bracket members 44 in order to achieve the desired depth between the fore and aft support members 78. The support clips 70 are thereafter positioned on their associated upright support members 78 in a substantially horizontal plane such that portions of the shelf support structure 20 are positioned on the respective clip seating surfaces 72 between the support members 78 and the clip retaining portions 74 as previously explained. Any plurality of the present shelf support structures 20 may be positioned between the existing shelf members 90 associated with a particular refrigerated cooler or other shelving equipment such as the unit 88 depending upon the space between such existing shelf members 90 as well as the overall height of the various products to be merchandised therewithin. Once the present shelf support structures 20 are positioned within a particular unit, a wide variety of different types of product merchandising units can be supported thereon for displaying products to consumers. The very fact that the present support structures 20 are both width and depth adjustable greatly facilitates their use in a multitude of different types of refrigerated coolers as well as other shelving and display equipment since the present support structures 20 can be expanded and contracted to accommodate the varying width and depth dimensions associated with the known units. In fact, depending upon the ease with which the shelf members 90 can be re-positioned within a particular shelving display, the shelf members 90 which typically come with many of the known display units can be removed from such units and replaced with the more easily maneuverable shelf support structures 20. This represents a one-inventory solution to a user enabling such user to organize and configure any particular refrigerated cooler or other display unit to meet his/her specific needs and space requirements thereby significantly reducing and minimizing the vertical space between shelved products in a particular display application.

Although not specifically illustrated in FIG. 8, placement of the present shelf support structures 20' in a typical display cooler such as the display cooler 88 illustrated in FIG. 8 is accomplished in a similar manner as described above with respect to the shelf support structures 20. Similarly, placement of the present shelf support structures 20" in a typical display cooler such as the display cooler 88 illustrated in FIG. 8 is accomplished by slidably moving the members 22" and 24" relative to each other in order to achieve the desired width between the upright cooler support members 78 and by slidably moving both rear members 64 within the bracket members 44" in order to achieve the desired depth between the fore and aft support members 78. Each rear member 64 is thereafter positioned on a respective rear clip seating surface 72 between the rod portions 68 and 69 as previously explained. In all other respects, the placement of the present shelf support structures 20' and 20" within a typical display cooler such as the display cooler 88 illustrated in FIG. 8 is as previously explained with respect to the shelf support structure 20.

FIGS. 9 and 10 illustrate the mounting of the present shelf support structure 20 in a gravity feed configuration within a typical display cooler. Certain known types of shelving systems such as the wide variety of existing visi-cooler systems are particularly adaptable for conversion to a gravity feed type operation by simply elevating the rear portion of the shelf members associated therewith to achieve an inclination such that when product merchandising units are positioned thereon, rows of products positioned on the respective merchandising units will slide under the force of gravity towards the front portion thereof in a smooth and steady manner and without toppling over. In similar fashion, the present shelf support structures 20, 20' and 20" can likewise be easily manipulated and seated on the clips 70 so as to achieve an inclined position for gravity feed type operations, the inclined orientation being achieved by simply elevating the rear support clips 70 to achieve the desired inclination. The present support structures 20, 20' and 20" can be positioned and seated on support clips 70 in a gravity feed orientation at any intermediate location within the cooler including between existing shelf members such as the shelf members 90 shown in FIG. 8. In FIG. 9, the support clips 70 are attachable to the upright support members 78 as illustrated in FIGS. 6 and 7 wherein the upright support members 78 are located adjacent the respective side walls of the particular cooler in question such as the cooler 88 illustrated in FIG. 8. In FIG. 10, however, the rearwardmost upright cooler support members 78 are located adjacent the rear wall of the particular cooler in question as compared to adjacent the side walls thereof. In this particular arrangement, the rear transverse member portions 58 and 60 (FIGS. 1–3) as well as the rear transverse rod portions 68 (FIG. 4) will engage and rest upon the respective rear clip seating surfaces 72 in similar fashion as previously explained and as shown in FIG. 10. In all other respects, placement of any one of the present shelf support structures 20, 20' and 20" in a display cooler having its rearwardmost upright support members located adjacent the rear cooler wall as illustrated in FIG. 10 is accomplished in a substantially similar fashion as previously explained with respect to FIGS. 8 and 9.

FIG. 11 illustrates use of the present shelf support structure 20 in a display cooler 89 wherein the cooler 89 includes vertical light means located adjacent the front portion thereof such as the vertical light member 92. More particularly, FIG. 11 is a partial top plan view of the front right hand corner of the shelf support structure 20 mounted within the display cooler 89, the offset construction of the present shelf support structure 20 being designed and configured to avoid the typical vertical light arrangement associated with known visi-cooler constructions. More specifically, as previously explained, the front portion of side member 34 includes an inwardly extending portion 86 and a forwardly extending portion 94 as shown in FIG. 11, which offset construction circumvents the light means 92. The front portion of side member 26 is likewise configured in a similar manner and includes an inwardly extending portion 82 and a forwardly extending portion 96 (FIG. 7) for the same reason as previously explained. This configuration allows all embodiments 20, 20' and 20" of the present shelf support structure to be used in display coolers which include vertical light means such as the vertical light member 92.

It is important to note that the front tubular member 32 as well as its telescoping rod member 40 are positioned and located above the other corresponding cross members 28,30, 36 and 38. The raised front members 32 and 40 were specifically designed to engage respective slots formed in the front wall portion of many of the product merchandising units manufactured and sold by Applicants assignee such as the slot 98 associated with the product merchandising unit 100 illustrated in FIG. 12. The depth or height of the slot 98 as well as the height of the upwardly extending rod portion 102 may be correlated to produce a desired shelf orientation when the unit 100 is positioned on the support structure 20 and the slot 98 is engaged with the front members 32 and 40. For example, such correlation may be that the unit 100, when engaged with the support structure 20, lies in a substantially horizontal position when the support structure 20 is likewise positioned in a substantially horizontal orientation. Other orientations are likewise possible. In any event, engagement of the slot 98 with the front members 32 and 40 serves as a stop mechanism for preventing fore and aft movement of the unit 100 when such unit is positioned on the support structure 20. This is particularly advantageous when the support structure 20 is positioned in an inclined orientation for gravity feed operations. This also prevents the front portion of unit 100 from sliding into contact with the cooler doors associated with the display coolers 88 and 89 during use. Regardless of the correlation between the depth of the slot 98 and the height of the rod portion 102, the rear support clips 70 can be easily adjusted up or down along the rear upright support members 78 such that when the support structure 20 is placed thereon and the product merchandising unit 100 is engaged therewith, the unit 100 can be positioned in either a substantially flat horizontal orientation or an inclined orientation for gravity feed applications. The same is also true with respect to the shelf structures 20' and 20".

The present shelf support structures 20 and 20" are also easily adaptable for holding and supporting other product merchandising units which do not include slot means 98. In this event, the forward portion of intermediate rod members 42 and 42" may be re-designed so as to conform to the forward portion of rod members 26 and 34 as illustrated in dotted outline form at 42A in FIG. 2. This re-configuration of rod members 42 and 42" to rod member 42A allows any existing product merchandising unit to be positioned and supported on the support structures 20 and 20" such that the front wall portion thereof lies adjacent to and behind the front members 32, 40 and 32", 40". This provides a relatively flat orientation for any product merchandising unit positioned on the support structures 20 and 20" and the elevation of the rear portion of the support structures 20 and 20" can be easily adjusted to achieve either a horizontal orientation or an inclined orientation as previously explained. It is also recognized and anticipated that, for certain applications, the front members 32, 40 and 32", 40" may be located in the same plane as the other cross members 28, 30, 36, 38 and 28", 30" 36", 38".

It is also important to note that the overall dimensions of the various support structures 20, 20' and 20" as well as the shape and configuration of the various members comprising such support structures are subject to wide variations and may be sized and shaped into a variety of different sizes and configurations so as to be compatible with the size and shape of the particular product merchandising display device into which the present support structures may be mounted, or to conform with any other space limitation, without impairing the teachings and practice of the present invention. It is also recognized and anticipated that only some of the plurality of cross members such as the members 28–32 and 36–40 may actually telescopingly cooperate with each other to provide the relative movement between the members 22 and 24, and that a wide variety of other interconnection means between the members 22, 22' and 24, 24' are possible and will achieve the desired relative movement between such members to vary the overall width of the structures.

Although it is preferred that the components comprising the overall support structures be constructed from basic metal wire, rod and/or tube stock, it is recognized that various other acceptable materials of construction are available and could likewise equally be employed to construct the various components of the present devices. It is therefore recognized that certain metal alloys, fiberglass, wood and other materials could be utilized in the practice of this invention. The selection of materials should take into account the type of products to be merchandised therefrom as well as their weight and the particular environment where the present support structures are to be located. It is also anticipated that the present support structures can be fabricated from coated materials. Materials of this description may consist of metal wire having various shapes and sizes which are formed to the desired configuration. The entire assembly may then be coated with vinyl or other suitable plastic material so that the entire assembly has a pleasing appearance and resists corrosion and scratching. Other suitable coatings are likewise possible.

Thus there has been shown and described several embodiments of a novel adjustable shelf support structure which is mountable within existing shelf and display equipment, including refrigerated visi-coolers, which support structures fulfill all of the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A shelf support structure adaptable for use with existing product merchandising display equipment comprising first and second relatively movable members, each of said first and second movable members having at least one portion thereof forming one opposed side portion of said support structure and each having a plurality of spaced members arranged transversely to said associated side portion, said plurality of spaced transverse members defining the width of said support structure and the length of said associated side portions defining the depth thereof, at least some of the spaced transverse members associated with each of said plurality of spaced transverse members having cross-sectional shapes adaptable for slidably receiving and engaging each other so as to enable said first and second members to be arranged in telescoping relationship with each other whereby said first and second members can be moved relative to each other to change the overall width of said support structure, each side portion of said first and second members including means for adjusting the effective length thereof so as to change the overall depth of said support structure, each of said adjustment means including an additional member having a first portion extending substantially parallel to said side portions and a second portion extending substantially perpendicular thereto, said first and second members when engaged with each other forming an open grid structure capable of both width and depth adjustment to accommodate the varying width and depth dimensions associated with existing product merchandising display equipment.

2. The shelf support structure defined in claim 1 wherein said adjustment means associated with each side portion of said first and second members includes at least one bracket member attached thereto, said bracket member including means for slidably receiving said additional member, said additional member being slidably movable within said bracket member so as to increase the effective length of each of said side portions.

3. The shelf support structure defined in claim 2 including stop means associated with one end portion of each of said additional members, said stop means preventing said additional members from becoming disengaged from said bracket members.

4. The shelf support structure defined in claim 3 wherein said stop means are removable from the one end portion of each of said additional members for allowing said additional members to be removed from said bracket members.

5. The shelf support structure defined in claim 1 wherein the second portions of said additional members include cross-sectional shapes adaptable for slidably receiving and engaging each other.

6. The shelf support structure defined in claim 1 wherein one of said plurality of spaced transverse members associated respectively with each of said first and second relatively movable members forms front wall means extending across said support structure between said opposed side portions, said front wall means being positioned and located above the other plurality of spaced transverse members.

7. The shelf support structure defined in claim 1 wherein the existing product merchandising display equipment includes a plurality of upright support members each having a plurality of vertically spaced slots formed therein, said slots being configured for receiving and holding a support clip, each of said upright support members having at least one support clip selectively attachable thereto, said shelf support structure being configured to rest upon said support clips, at least a portion of said shelf support structure located in the vicinity of each respective corner thereof resting upon a respective support clip when positioned thereon.

8. The shelf support structure defined in claim 7 wherein each of said opposed side portions includes a downwardly extending portion positioned for engagement with a portion of at least one of said support clips so as to limit forward movement of said support structure.

9. The shelf support structure defined in claim 7 wherein each of said opposed side portions includes an inwardly extending portion positioned for engagement with a portion of at least one of said support clips so as to limit rearward movement of said support structure.

10. The shelf support structure defined in claim 9 wherein the existing product merchandising display equipment includes vertical light means, each of said opposed side portions including a portion extending forward from said inwardly extending portion, said inwardly extending portion and said forwardly extending portion being configured for avoiding the vertical light means associated with the product merchandising display equipment when said support structure is positioned on said support clips.

11. The shelf support structure defined in claim 1 wherein said adjustment means associated with each side portion of said first and second members includes a bracket member attached to said corresponding side portion and a bracket member attached to another portion of said corresponding first or second member, each of said additional members being substantially U-shaped in configuration, each of said U-shaped members being engageable with one of said pair of bracket members and each being movable relative thereto so as to change the effective depth of said support structure.

12. A shelf support structure adaptable for use with existing product merchandising display equipment comprising first and second relatively movable members, each of said first and second movable members having at least a portion thereof forming one opposed side portion of said support structure and each having a plurality of spaced members arranged transversely to said associated side portion, at least some of the spaced transverse members associated with one of said first and second movable members having means associated therewith for slidably engaging at least some of the spaced transverse members associated with the other of said first and second movable members so as to enable said first and second members to be moved relative to each other to change the overall distance between the respective portions of said first and second members forming the opposed side portions of said support structure, and means engageable with each side portion of said first and second members for adjusting the effective length thereof so as to change the overall depth of said support structure, said adjustment means including an additional member having first and second portions extending substantially parallel to said side portions and a third portion extending substantially parallel to at least one of said transverse members, said first and second members when engaged with each other forming an open grid structure capable of both width and depth adjustments to accommodate the varying width and depth dimensions associated with existing product merchandising display equipment.

13. The shelf support structure defined in claim 12 wherein said slidably engaging means associated with at least some of said spaced transverse members includes at least one bracket member attached thereto, each of said bracket members including means for slidably receiving at least one of said transverse members.

14. The shelf support structure defined in claim 13 wherein said at least one bracket member is positioned to prevent separation of said first and second members.

15. The shelf support structure defined in claim 12 wherein said means engageable with each side portion of said first and second members for adjusting the effective length thereof includes at least one bracket member attached respectively thereto, said bracket members including means for slidably receiving the first and second portions of said additional member, said additional member being movable within said bracket members so as to increase the effective depth of said support structure.

16. The shelf support structure defined in claim 15 wherein the third portion of said additional member is adjustable to vary the length of said third portion.

17. A shelf support structure adaptable for use with existing product merchandising display equipment comprising first and second relatively movable members, each of said first and second movable members having at least a portion thereof forming one opposed side portion of said support structure and each having a plurality of spaced members arranged transversely to said associated side portion, at least some of the spaced transverse members associated with one of said first and second movable members having means associated therewith for engaging at least some of the spaced transverse members associated with the other of said first and second movable members so as to enable said first and second members to be moved relative to each other to change the overall distance between the respective portions of said first and second members forming the opposed side portions of said support structure, each side portion of said first and second members including means for adjusting the effective length thereof so as to change the overall depth of said support structure, each of said adjustment means including an additional member having a first portion extending substantially parallel to said side portions and a second portion extending substantially perpendicular thereto, said first and second members when engaged with each other forming an open grid structure capable of both width and depth adjustments to accommodate the varying width and depth dimensions associated with existing product merchandising display equipment.

18. The shelf support structure defined in claim 17 wherein said adjustment means associated with each side portion of said first and second members includes at least one bracket member attached thereto, said bracket member including means for slidably receiving said additional member, said additional member being slidably movable within said bracket member so as to increase the effective length of said respective side portion.

19. The shelf support structure defined in claim 17 wherein the second portions of said additional members include cross-sectional shapes adaptable for slidably receiving and engaging each other.

20. The shelf support structure defined in claim 17 wherein said adjustment means associated with each side portion of said first and second members includes a bracket member attached to said corresponding side portion and a bracket member attached to another portion of said corresponding first or second member, each of said additional members being substantially U-shaped in configuration, each of said U-shaped members being engageable with one of said pair of bracket members and each being movable relative thereto so as to change the effective depth of said support structure.

21. A shelf support structure adaptable for use with existing product merchandising display equipment comprising first and second relatively movable members, each of said first and second movable members having at least a portion thereof forming one opposed side portion of said support structure, each opposed side portion including an offset portion located near the front portion thereof, each of said first and second relatively movable members having a plurality of spaced members arranged transversely to said associated side portion, at least some of the spaced transverse members associated with one of said first and second movable members having means associated therewith for engaging at least some of the spaced transverse members associated with the other of said first and second movable members so as to enable said first and second members to be moved relative to each other to change the overall distance between the respective portions of said first and second members forming the opposed side portions of said support structure, and means engageable with said first and second members for adjusting the overall depth of said support structure, said first and second members when engaged with each other forming an open grid structure capable of both width and depth adjustments to accommodate the varying width and depth dimensions associated with existing product merchandising display equipment.

22. The shelf support structure defined in claim 21 wherein said means engageable with said first and second members for adjusting the overall depth of said support structure includes a pair of bracket members attachable to said first member, a pair of bracket members attachable to said second member, and a pair of substantially U-shaped members, each of said substantially U-shaped members being engageable with one of said pair of bracket members and each being movable relative thereto so as to change the effective depth of said support structure.

23. The shelf support structure defined in claim 22 wherein the existing product merchandising display equipment includes a plurality of upright support members each having a plurality of spaced openings associated therewith, said openings being configured for receiving and holding a support clip, each of said upright support members having at least one support clip selectively attachable thereto, each of said substantially U-shaped members being positioned, located and configured such that at least a portion thereof will rest upon a support clip when said support structure is positioned within said product merchandising display equipment.

* * * * *

UNITED STATES PATENT AND TRADEMARK OFFICE

CERTIFICATE OF CORRECTION

PATENT NO. : 5,645,182

DATED : July 8, 1997

INVENTOR(S) : Donald J. Miller, Jr., et. al.

It is certified that error appears in the above-identified patent and that said Letters Patent is hereby corrected as shown below:

Column 1, line 9, "supposing" should be -- supporting --.

Column 2, line 11, "fiat" should be -- flat --.

Column 4, line 23, "Fig. As" should be -- Fig. 6 is --.

Column 8, line 45, "1'4" should be -- 1-4 --.

Column 11, line 17, "Applicants" should be -- Applicants' --.

Signed and Sealed this

Twenty-third Day of December, 1997

Bruce Lehman

*Attest:*

BRUCE LEHMAN

*Attesting Officer*

*Commissioner of Patents and Trademarks*